US007677303B2

(12) United States Patent
Coronado

(10) Patent No.: US 7,677,303 B2
(45) Date of Patent: Mar. 16, 2010

(54) ZERO-RELAXATION PACKER SETTING LOCK SYSTEM

(75) Inventor: Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 100 days.

(21) Appl. No.: 12/102,689

(22) Filed: Apr. 14, 2008

(65) Prior Publication Data

US 2009/0255692 A1 Oct. 15, 2009

(51) Int. Cl.
*E21B 33/128* (2006.01)

(52) U.S. Cl. ..... 166/187; 166/387; 166/196

(58) Field of Classification Search ..... 166/187, 166/191, 196, 325, 387; 277/337, 338
See application file for complete search history.

(56) References Cited

U.S. PATENT DOCUMENTS 3,059,699 A * 10/1962 Brown ..... 166/187
3,221,818 A * 12/1965 Bostock et al. ..... 277/338
3,298,441 A * 1/1967 Young ..... 166/179
3,316,969 A * 5/1967 Smith ..... 166/387

FOREIGN PATENT DOCUMENTS

RU 2021486 C1 * 10/1994

* cited by examiner

*Primary Examiner*—Kenneth Thompson
(74) *Attorney, Agent, or Firm*—Shawn Hunter

(57) ABSTRACT

A packer mandrel is radially surrounded by an axially compressible packer element and a backing ring. A setting sleeve arrangement also surrounds the packer mandrel adjacent the packer element. A hydraulic locking mechanism is used to secure the setting sleeve arrangement against the packer element. The hydraulic locking mechanism includes an expansible fluid-sealed chamber that is defined between the setting sleeve and the central packer mandrel.

18 Claims, 2 Drawing Sheets

ZERO-RELAXATION PACKER SETTING LOCK SYSTEM

BACKGROUND OF THE INVENTION

1. Field of the Invention

The invention relates generally to packer devices used within a wellbore.

2. Description of the Related Art

Packer devices are used to establish a fluid seal within a wellbore. Packers are often incorporated into production tubing strings and then used to form a fluid seal between the outside surface of the tubing string and the inner wall of the wellbore. A number of packer designs incorporate an annular elastomeric sealing element which is placed into a set configuration by axially compressing it. The axial compression causes the packer element to be extruded radially outwardly and into sealing contact against the wellbore wall.

Ordinarily, a setting sleeve is used to apply the compression force to the packer element. A body lock ring is often used as a means to trap the setting force and linear travel of the setting sleeve. A body lock ring is a known device that incorporates a split-ring member that travels over the mandrel of the packer as the packer element is being compressed. The mandrel and inside radial surface of the body lock ring have complimentary wicker-type teeth which prevent the body lock ring from traveling back once the packer element is set. Due to the nature of the tooth profile, however, there is always some slight "back travel" in the body lock ring system as the toothed system relaxes. This generally is not a major issue when using elastomer-type resilient packing elements. But when using relatively rigid packer element systems, minor amounts of back travel can allow the element to relax sufficiently to allow fluid leakage past the packer element following setting.

SUMMARY OF THE INVENTION

The invention provides methods and devices to provide a more positive means to secure a packer element in a set position and prevent back travel that could result in leakage past the packer element after setting. An exemplary setting arrangement is described wherein there is zero relaxation of the setting arrangement. Within this specification, the term "zero relaxation" is intended to means that there is essentially no relaxation, or no significant relaxation of the setting arrangement.

A packer assembly is described in which a packer mandrel is radially surrounded by an axially compressible packer element and a backing ring. A setting sleeve arrangement also surrounds the packer mandrel adjacent the packer element. A hydraulic locking mechanism is used to secure the setting sleeve arrangement against the packer element. The hydraulic locking mechanism preferably includes an expansible fluid-sealed chamber that is defined between the setting sleeve and the central packer mandrel. A fluid passage interconnects the fluid-sealed chamber with an external fluid source, such as the central flowbore. A one-way check valve is associated with the passage such that fluid may enter the chamber via the passage, but may not exit the chamber via the passage.

In order to set the packer device, the setting sleeve is contacted by an actuating member, such as the working end of a hydraulic ram or setting tool. The actuating member urges the setting sleeve axially against the packer element and compresses it against the backing ring. As the packer element is compressed, it expands radially outwardly into sealing engagement with a surrounding wellbore wall. Axial movement of the setting sleeve with respect to the packer mandrel will expand the internal volume of the chamber and draw fluid into the chamber via the fluid passage. Fluid pressure from fluid trapped within the fluid sealed chamber will then maintain the setting sleeve against the packer element.

In practice, the setting arrangement of the present invention provides a positive setting force with zero relaxation of the setting system to provide for a more robust sealing by the packer element. The amount of back travel in the setting arrangement is minimized.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
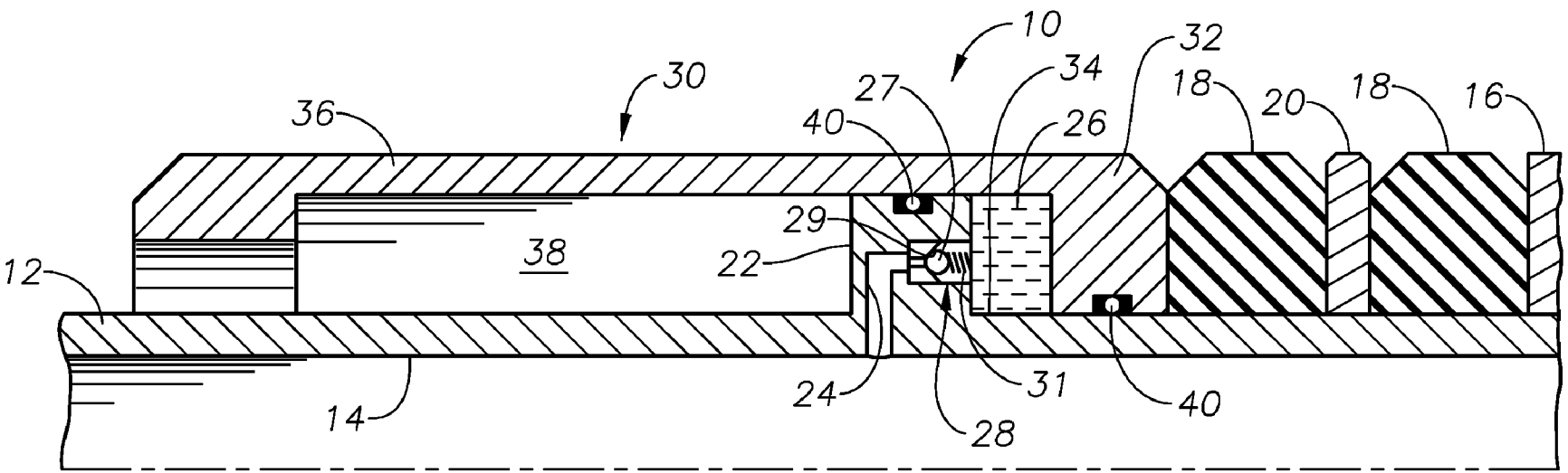
FIG. 1 is a side, one-quarter cross-sectional view of an exemplary packer assembly constructed in accordance with the present invention in an unset position.

FIG. 1 illustrates an exemplary packer device 10 having a central packer mandrel 12 which defines a central axial flowbore 14 along its length. Radially surrounding the central mandrel 12 is a backing ring 16. Where the packer device 10 is intended to be a permanently-set device, the backing ring 16 is preferably secured to the central mandrel 12 using threading, splining, or another known technique for fixedly securing the backing ring 16 against axial movement with respect to the mandrel 12. Where the packer device 10 is intended to be a releasable packer device, the backing ring 16 is releasably secured to the mandrel 12. This may be done by using a release key or by other techniques known in the art. Releasable packer systems which incorporate release keys are available commercially, including, for example, the Model SC-2 packer from Baker Oil Tools of Houston, Tex. A pair of annular packer elements 18 are located adjacent the backing ring 16 and separated axially by a spacer ring 20. In the depicted embodiment, the packer elements 18 are substantially comprised of a deformable thermoplastic material, such as TEFLON®. The packer elements 18 may also be fashioned from expandable metals, of a type known in the art to be plastically deformed during setting. However, the packer elements 18 may also be fashioned from elastomers or other suitable materials. There may be more than two packer element 18 or a single packer element 18.

The central mandrel 12 presents an outwardly projecting annular flange 22. The flange 22 contains a fluid passage 24 that interconnects the central flowbore 14 with fluid chamber 26. A spring-biased check valve assembly 28 of a type known in the art is located within the passage 24. The check valve assembly 28 is preferably a ball-type check valve wherein a ball 27 is biased against a ball seat 29 by a compressive spring 31. However, other types of fluid check valves may be used as well. The check valve assembly 28 is oriented such that fluid can enter the chamber 26 from the passage 24 but cannot exit the chamber 26 past the check valve assembly 28.

A setting sleeve 30 radially surrounds the central mandrel 12 and the annular flange 22. The setting sleeve 30 is disposed adjacent the packer elements 18 and is axially moveable with respect to the mandrel 12. The setting sleeve 30 includes a compression end portion 32 that lies in contact with the outer radial surface 34 of the mandrel 12. The setting sleeve 30 also includes an outlying shroud portion 36. An annular space 38 is defined between shroud portion 36 and the central packer mandrel 12. Fluid seals 40 are provided between the compression end portion 32 and the mandrel 12 as well as between the shroud 36 and the flange 22. The fluid seals 40 serve to isolate the chamber 26 against fluid ingress and egress.

Figure 2:
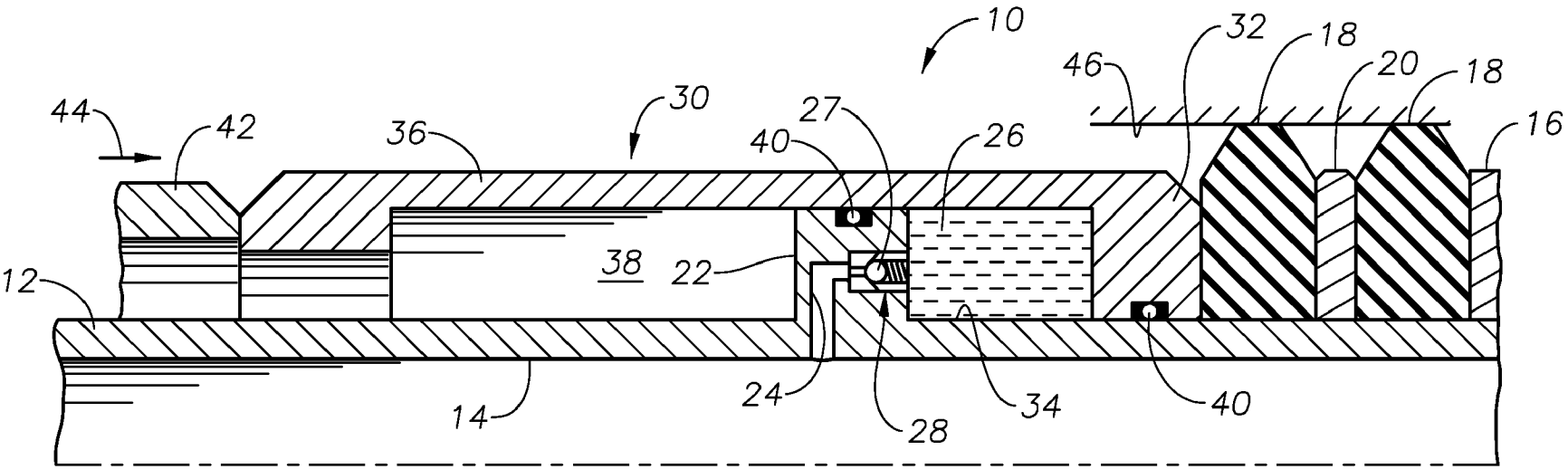
FIG. 2 is a side, one-quarter cross-sectional view of an exemplary packer assembly constructed in accordance with the present invention now in a set position.

FIG. 1 depicts the packer assembly 10 in a run-in configuration and prior to actuation. Preferably, the fluid sealed chamber 26 is filled with fluid prior to running into the wellbore. The chamber 26 may be pre-filled with a hydraulic fluid or oil, of types known in the art. Alternatively, the chamber 26 may fill with fluids within a wellbore via the check valve 28 as the packer assembly 10 is run into the well. A substantially incompressible fluid is preferred for operation of the packer assembly 10. In operation to set the packer device 10, the setting sleeve 30 is contacted by an actuating member 42 (FIG. 2). The actuating member 42 may be the working end of a hydraulic ram or of a packer setting tool. The actuating member 42 moves in the direction of arrow 44 and urges the setting sleeve 30 against the packer elements 18. The backing ring 16 provides a surface against which the packer elements 18 are compressed. The packer elements 18 are axially compressed against the backing ring 16, and this compression results in the packer elements 18 being radially expanded outwardly and into sealing engagement with the wellbore wall 46. As the setting sleeve 30 is moved axially with respect to the central mandrel 12, the internal volume of the chamber 26 is expanded causing fluid to flow into the chamber 26 via the passage 24 from the flowbore 14. This fluid is trapped within the chamber 26 by the check valve 28. Fluid pressure within the chamber 26 positively urges the compression end portion 32 against the packer elements 18 to cause them to remain in a set position. Further, the fluid within the chamber 26 prevents the sleeve 30 from reverse axial movement away from the packer elements 18.

The packer device 10 may be a permanently-set packer that is intended to remain in place and not be released from its set position. In addition, the packer device 10 may be a releasable packer device. If it is desired to release the packer elements 18 from sealing engagement with the wellbore wall 46, this may be done by releasing the backing ring 16 from engagement with the packer mandrel 12. Release of the backing ring 16 will permit the backing ring 16 to be moved axially with respect to the mandrel 12 and remove the axial compression from the packer elements 18. The device used to set the packer device 10 may also be a hydraulic setting device wherein the check valve assembly 28 would be incorporated into the inlet for the hydraulic setting chamber. The packer design depicted in FIG. 1 could be set by applying hydraulic pressure within the bore of mandrel 12 which is then transferred to fluid chamber 26. This creates a setting force between the sets of seals 40, thus driving the sleeve 30 against the packing element 18 assembly.

The packer setting mechanism of the present invention provides a positive hydraulic locking mechanism to secure packing elements 18 in a set position. In practice, the setting mechanism of the present invention provides for zero-relaxation of the setting system and virtually no back travel which could permit fluid leakage past the packer elements 18.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A packer device comprising:

a central packer mandrel defining a fluid flowbore;

a packer element radially surrounding the mandrel, the packer element being radially compressible between an unset position wherein the packer element is not in sealing contact with a surrounding wellbore wall, and a set position wherein the packer element is in sealing contact with a surrounding wellbore wall;

a hydraulic locking mechanism for selectively moving the packer element to its set position, the hydraulic locking mechanism comprising:

a setting sleeve radially surrounding and axially moveable with respect to the packer mandrel;

a fluid chamber;

a fluid passage defined within the packer mandrel to provide fluid communication between the fluid chamber and the fluid flowbore;

a check valve operationally associated with the fluid passage to provide one-way fluid entry into the fluid chamber; and wherein axial movement of the setting sleeve draws fluid into the fluid chamber through the fluid passage, the fluid preventing reverse axial movement of the setting sleeve to maintain the packer element in the set position.

2. The packer device of claim 1 wherein the fluid chamber is defined between the packer mandrel and the setting sleeve.

3. The packer device of claim 1 wherein the packer element is substantially comprised of a non-elastomeric material.

4. The packer device of claim 1 wherein the check valve comprises a ball-type check valve comprising:

a ball seat;

a ball valve member; and a compressive spring which resiliently biases the ball valve member against the ball seat.

5. The packer device of claim 1 further comprising a backing ring radially surrounding and fixedly secured to the packer mandrel, the backing ring providing a surface against which the packer element is axially compressed.

6. The packer device of claim 1 wherein there is a plurality of packer elements.

7. The packer device of claim 1 wherein the packer element is substantially comprised of an elastomeric material.

8. The packer device of claim 3 wherein the packer element is substantially comprised of thermoplastic.

9. The packer device of claim 3 wherein the packer element is substantially comprised of metal.

10. A packer device setting assembly for axially compressing a packer element into a set position, the packer device setting assembly comprising:

a central packer mandrel defining a fluid flowbore;

a setting sleeve radially surrounding and axially moveable with respect to the packer mandrel;

a fluid chamber;

a fluid passage defined within the packer mandrel to provide fluid communication between the fluid chamber and the fluid flowbore;

a check valve operationally associated with the fluid passage to provide one-way fluid entry into the fluid chamber; and wherein axial movement of the setting sleeve draws fluid into the fluid chamber through the fluid passage, the fluid preventing reverse axial movement of the setting sleeve to maintain the packer element in the set position.

11. The packer device of claim 10 wherein the fluid chamber is defined between the packer mandrel and the setting sleeve.

12. The packer device of claim 10 wherein the check valve comprises a ball-type check valve comprising:

a ball seat;

a ball valve member; and a compressive spring which resiliently biases the ball valve member against the ball seat.

13. The packer device setting assembly of claim 10 wherein the fluid chamber is expandable to provide variable volume.

14. The packer device setting assembly of claim 10 further comprising a backing ring radially surrounding and fixedly secured to the packer mandrel, the backing ring providing a surface against which the packer element is axially compressed.

15. The packer device of claim 14 wherein the backing ring is releasably secured to the packer mandrel.

16. A method for setting a packer element which radially surrounds a central packer mandrel into sealing engagement with a surrounding wellbore wall, the method comprising the steps of:

axially urging a setting sleeve against the packer element to axially compress the packer element and cause the packer element to expand radially outwardly into sealing engagement with the wall;

selectively flowing fluid into a fluid chamber defined radially between the setting sleeve and the packer mandrel as the setting sleeve is urged against the packer element; and precluding fluid from exiting the fluid chamber such that fluid pressure within the fluid chamber maintains the setting sleeve against the packer element.

17. The method of claim 16 wherein the step of precluding fluid from exiting the fluid chamber further comprises blocking exit of fluid with a check valve.

18. The method of claim 16 wherein the setting sleeve is axially urged against the packer element by an actuating member.

* * * * *